US012331973B2

(12) United States Patent
Allard et al.

(10) Patent No.: US 12,331,973 B2
(45) Date of Patent: Jun. 17, 2025

(54) REFRIGERATOR WITH ANTI-CONDENSATION FEATURES

(71) Applicant: WHIRLPOOL CORPORATION, Benton Harbor, MI (US)

(72) Inventors: Paul B. Allard, Coloma, MI (US); Sanjesh Kumar Pathak, Stevensville, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 116 days.

(21) Appl. No.: 17/492,717

(22) Filed: Oct. 4, 2021

(65) Prior Publication Data

US 2023/0105421 A1 Apr. 6, 2023

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01)

(58) Field of Classification Search
CPC ..... F25B 49/02; F25B 13/00
See application file for complete search history.

(56) References Cited

U.S. PATENT DOCUMENTS 4,481,787 A * 11/1984 Lynch ..... F25D 11/02 236/46 R
2006/0048531 A1* 3/2006 Eisenhour ..... F25B 49/022 62/228.3
2012/0017612 A1 1/2012 Junge et al.
2012/0047922 A1* 3/2012 Lee ..... F25D 23/061 62/89
2017/0191733 A1* 7/2017 Li ..... F25D 21/02
2017/0211871 A1* 7/2017 Herrera ..... F25D 21/14
2020/0198443 A1* 6/2020 Kato ..... B60H 1/00278

FOREIGN PATENT DOCUMENTS

CN 106766578 A 5/2017
CN 106802051 A 6/2017
CN 106839608 A 6/2017
(Continued)

OTHER PUBLICATIONS

Bianchi, Refrigerator with optimized food preservation control, 2008, Full Document (Year: 2008).*

*Primary Examiner* — Nael N Babaa
(74) *Attorney, Agent, or Firm* — Price Heneveld LLP

(57) ABSTRACT

A method of controlling condensation on an appliance includes the steps of (1) providing a refrigerator having a refrigerant circuit with a heat loop, wherein the heat loop is configured to circulate heated refrigerant within a cabinet structure during a duty cycle of a compressor, and further wherein the refrigerator includes a storage compartment and an insulation space substantially surrounding the same; (2) running an insulation performance test, wherein a rate of temperature rise within the storage compartment is calculated during an off-duty cycle of the compressor; (3) sending the data to a controller for processing; (4) initiating the duty cycle of the compressor when the rate of temperature rise reaches a predetermined threshold rate; and (5) changing an operating parameter of the refrigerator to increase a time interval for which the duty cycle of the compressor is run.

11 Claims, 7 Drawing Sheets

(56) References Cited

FOREIGN PATENT DOCUMENTS

| | | | | | |
|---|---|---|---|---|---|
| EP | 2172725 | A1 * | 4/2010 | ..... | F25D 29/00 |
| EP | 2743616 | A3 | 7/2016 | | |
| JP | H10197122 | | 7/1998 | | |
| JP | 2000065461 | A | 3/2000 | | |
| JP | 2003302146 | A | 10/2003 | | |
| JP | 2014020715 | A | 2/2014 | | |

* cited by examiner

REFRIGERATOR WITH ANTI-CONDENSATION FEATURES

BACKGROUND

The present device generally relates to a refrigerator, and more specifically, to a refrigerator having anti-condensation features.

SUMMARY

In at least one aspect, a method of controlling condensation on an appliance includes the steps of (1) providing a refrigerator with a cabinet structure, a door operably coupled to the cabinet structure for selectively providing access to a storage compartment, a compressor, one or more sensors, a controller operably coupled to the compressor and the one or more sensors, a heat loop operably coupled to the compressor, wherein the heat loop circulates a heated medium during a duty cycle of the compressor; (2) sensing a first temperature level using the one or more sensors within the storage compartment at a first time interval during an off-duty cycle of the compressor; (3) sensing a second temperature level using the one or more sensors within the storage compartment at a second time interval during the off-duty cycle of the compressor; (4) calculating a rate of temperature rise within the storage compartment using the controller; (5) initiating the duty cycle of the compressor when the rate of temperature rise reaches a predetermined threshold rate; and (6) changing an operating parameter of the refrigerator to increase the duty cycle of the compressor.

In at least another aspect, a method of controlling condensation on an appliance includes the steps of (1) providing a refrigerator having a refrigerant circuit with a heat loop, wherein the heat loop is configured to circulate heated refrigerant adjacent to an exterior surface of a cabinet structure during a duty cycle of a compressor; (2) using one or more sensors to collect data, wherein the data includes a temperature value of the exterior surface of the cabinet structure, an ambient air temperature value associated with the exterior surface of the cabinet structure, and a relative humidity value associated with the exterior surface of the cabinet structure; (3) sending the data to a controller for processing; (4) calculating a dew point temperature value from the data using the controller; (5) comparing the dew point temperature value with the temperature value of the exterior surface of the cabinet structure using the controller; (6) initiating the duty cycle of the compressor when the temperature value of the exterior surface of the cabinet structure reaches a threshold temperature relative to the dew point temperature value; and (7) changing an operating parameter of the refrigerator to increase a time interval for which the duty cycle of the compressor is run.

In at least another aspect, a method of controlling condensation on an appliance includes the steps of (1) providing a refrigerator having a refrigerant circuit with a heat loop, wherein the heat loop is configured to circulate heated refrigerant within a cabinet structure during a duty cycle of a compressor, and further wherein the refrigerator includes a storage compartment and an insulation space substantially surrounding the same; (2) running an insulation performance test, wherein a rate of temperature rise within the storage compartment is calculated during an off-duty cycle of the compressor; (3) sending the data to a controller for processing; (4) initiating the duty cycle of the compressor when the rate of temperature rise reaches a predetermined threshold rate; and (5) changing an operating parameter of the refrigerator to increase a time interval for which the duty cycle of the compressor is run.

These and other features, advantages, and objects of the present device will be further understood and appreciated by those skilled in the art upon studying the following specification, claims, and appended drawings.

DETAILED DESCRIPTION OF EMBODIMENTS

Figure 1:
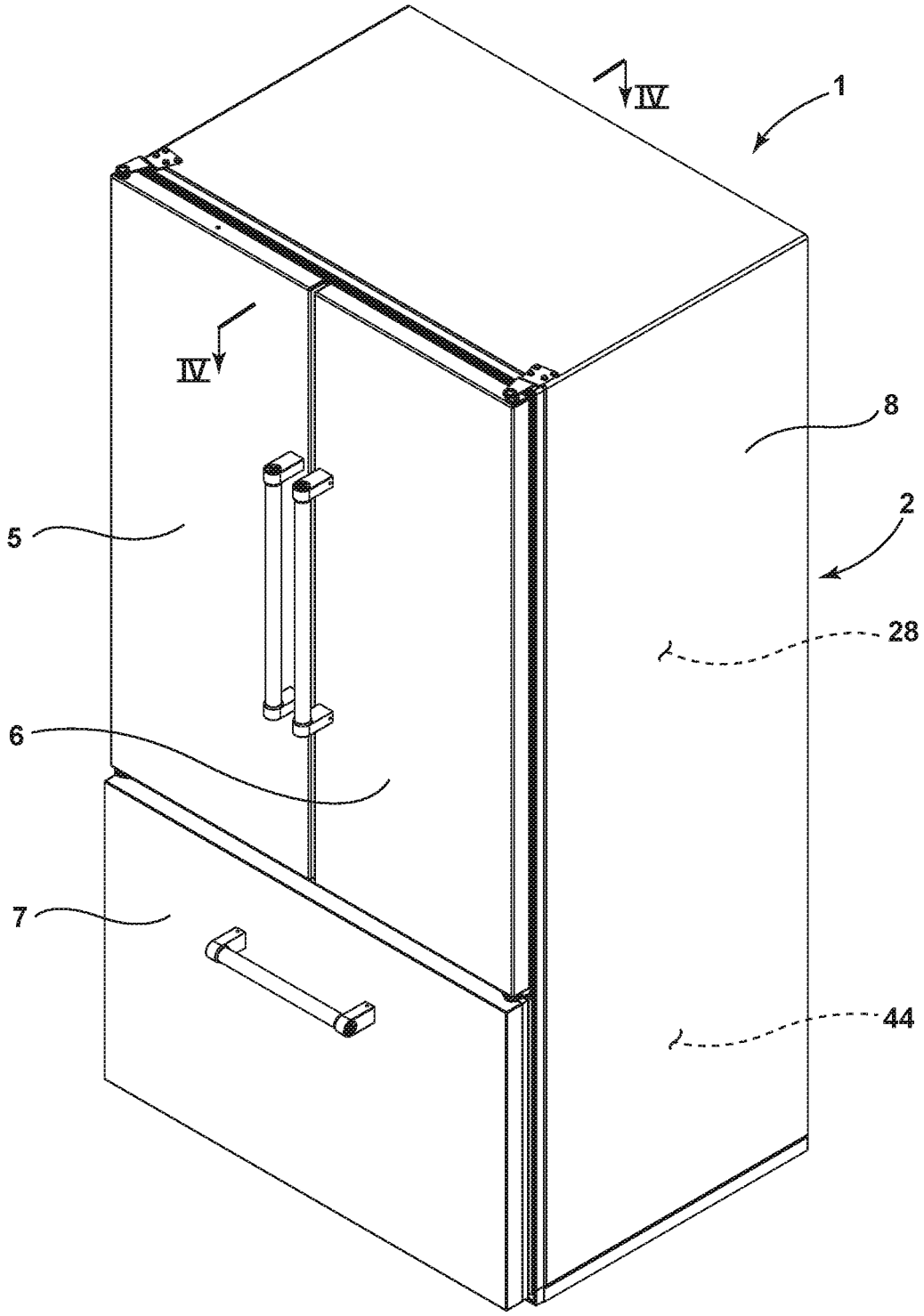
FIG. 1 is a top perspective view of a refrigerator.

The present illustrated embodiments reside primarily in combinations of method steps and apparatus components related to an anti-condensation feature for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

The terms "substantial," "substantially," and variations thereof, as used herein, are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

With reference to FIG. 1, a refrigerator 1 includes a cabinet structure 2 which, in the embodiment of FIG. 1, further includes a refrigerator compartment 28 positioned above a freezer compartment 44. The refrigerator compartment 28 and the freezer compartment 44 may be referred to herein as compartments 28, 44 and may also be referred to herein on an individual basis as a storage compartment. Doors 5 and 6 are provided to selectively provide access to the refrigerator compartment 28, while a drawer 7 is used to provide access to the freezer compartment 44. The cabinet structure 2 is surrounded by an exterior wrapper 8. The configuration of the refrigerator 1 as shown in FIG. 1 is exemplary only and the present concept is contemplated for use in all refrigerator styles including, but not limited to, side-by-side refrigerators, whole refrigerator and freezers, and refrigerators with upper freezer compartments.

Figure 2:
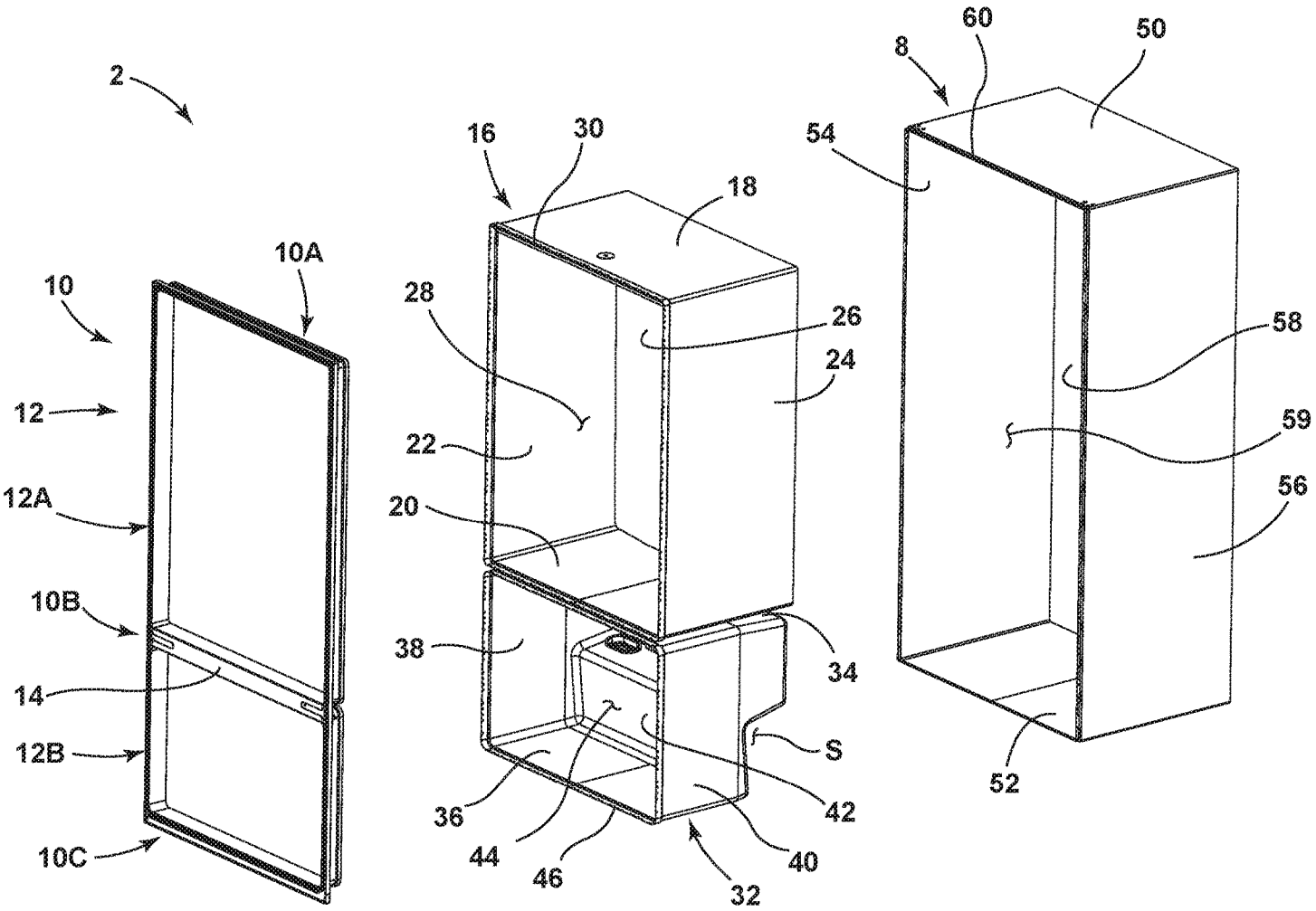
FIG. 2 is an exploded top perspective view of a cabinet structure from the refrigerator of FIG. 1.

Referring now to FIG. 2, the cabinet structure 2 generally includes a trim breaker 10. In the embodiment shown in FIG. 2, the trim breaker 10, or thermal bridge, includes a frame 12 having an upper opening 12A and a lower opening 12B with a mullion portion 14 disposed therebetween. The trim breaker 10 further includes an upper portion 10A, a middle portion 10B and a lower portion 10C.

As further shown in the embodiment of FIG. 2, the cabinet structure 2 further includes a refrigerator liner 16 having a top wall 18, a bottom wall 20, opposed sidewalls 22, 24, and a rear wall 26. Together, the walls 18, 20, 22, and 24 of the refrigerator liner 16 cooperate to define the refrigerator compartment 28 when the cabinet structure 2 is assembled. The refrigerator liner 16 further includes a front edge 30 disposed on a front portion thereof. The front edge 30 is disposed along the top wall 18, the bottom wall 20 and the opposed sidewalls 22, 24 in a quadrilateral ring configuration.

As further shown in the embodiment of FIG. 2, a freezer liner 32 is provided and includes a top wall 34, a bottom wall 36, opposed sidewalls 38, 40, and a rear wall 42. Together, the walls 34, 36, 38, 40 and 42 of the freezer liner 32 cooperate to define the freezer compartment 44. The rear wall 42 is shown in FIG. 2 as being a contoured rear wall that provides a spacing S for housing mechanical equipment 43 (FIG. 4) for cooling both the refrigerator compartment 28 and freezer compartment 44. Such equipment may include a compressor, a condenser, an expansion valve, an evaporator, a plurality of conduits, and other related components used for cooling the refrigerator and freezer compartments 28, 44, as further described below with specific reference to FIG. 7. As further shown in the embodiment of FIG. 2, the freezer liner 32 includes a front edge 46 disposed on a front portion thereof. The front edge 46 is disposed along the top wall 34, the bottom wall 36 and the opposed sidewalls 38, 40 in a quadrilateral ring configuration. In assembly, the front edge 30 of the refrigerator liner 16 and the front edge 46 of the freezer liner 32 are configured to couple with coupling portions disposed about the upper and lower openings 12A, 12B of the trim breaker 10.

As further shown in FIG. 2, the cabinet structure 2 also includes the exterior wrapper 8. In the embodiment of FIG. 2, the exterior wrapper 8 includes a top wall 50, a bottom wall 52, opposed sidewalls 54, 56, and a rear wall 58 which cooperate to define a cavity 59. The exterior wrapper 8 further includes a front edge 60 which is disposed along the top wall 50, the bottom wall 52, and the opposed sidewalls 54, 56 in a quadrilateral ring configuration. In assembly, the front edge 60 of the exterior wrapper 8 is coupled to coupling portions of the trim breaker 10 around the refrigerator liner 16 and the freezer liner 32. In this way, the trim breaker 10 interconnects the exterior wrapper 8 and the refrigerator liner 16 and the freezer liner 32 when assembled. Further, the refrigerator liner 16 and the freezer liner 32 are received within the cavity 59 of the exterior wrapper 8 when assembled, such that an insulation space 62 (FIG. 3) is defined between the outer surfaces of the refrigerator liner 16 and the freezer liner 32 relative to the inner surfaces of the exterior wrapper 8. The insulation space 62 can be used to create a vacuum insulated cavity provided at a negative pressure, or can be used to receive an insulation material to insulate the refrigerator compartment 28 and the freezer compartment 44, or both.

Figure 3:
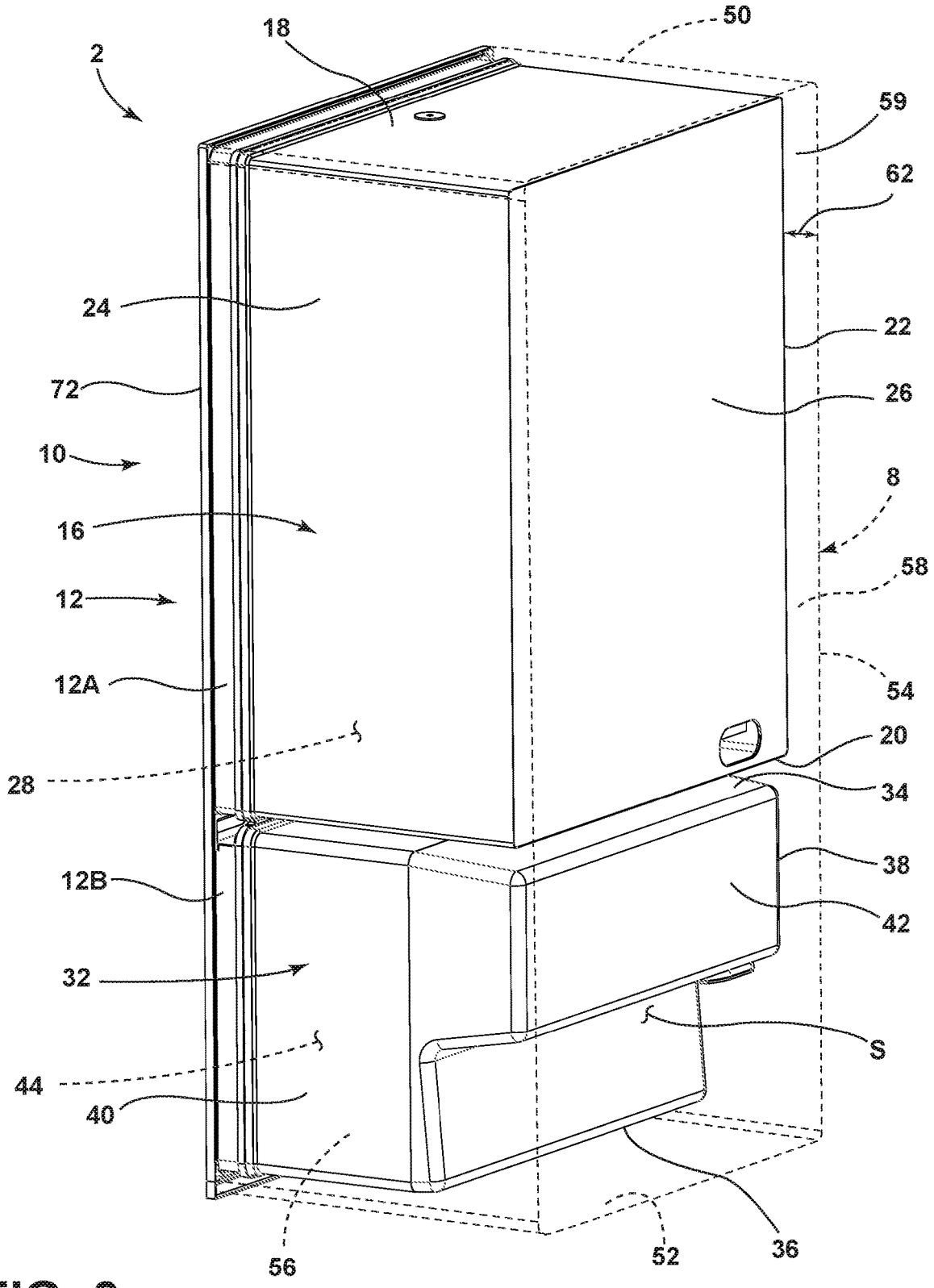
FIG. 3 is a rear top perspective view of the cabinet structure of FIG. 2 as assembled.

When the cabinet structure 2 is contemplated to be a vacuum insulated cabinet structure, the trim breaker 10 may be configured to provide an air-tight connection between the exterior wrapper 8 and the liners 16, 32 which allows for a vacuum to be held between the trim breaker 10, the exterior wrapper 8 and the liners 16, 32 in the insulation space 62 (FIG. 3). The trim breaker 10 may also be formed from any suitable material that is substantially impervious to gasses to maintain a vacuum in the insulation space 62, if so desired.

Referring now to FIG. 3, when the cabinet structure 2 is assembled, the trim breaker 10 connects to the front edge 60 (FIG. 2) of the exterior wrapper 8, and further connects to the front edge 30 (FIG. 2) of the refrigerator liner 16, and to the front edge 46 (FIG. 2) of the freezer liner 32. In this way, the trim breaker 10 interconnects the exterior wrapper 8 and the liners 16, 32. When refrigerator 1 (FIG. 1) is in use, the exterior wrapper 8 is typically exposed to ambient room temperature air, whereas the liners 16, 32 are generally exposed to refrigerated air in the refrigerator compartment 28 or the freezer compartment 44. With the trim breaker 10 being made of a material that is substantially non-conductive with respect to heat, the trim breaker 10 reduces transfer of heat from the exterior wrapper 8 to the liners 16, 32. As shown in FIG. 3, the insulation space 62 substantially surrounds the refrigerator compartment 28 and the freezer compartment 44.

Figure 4:
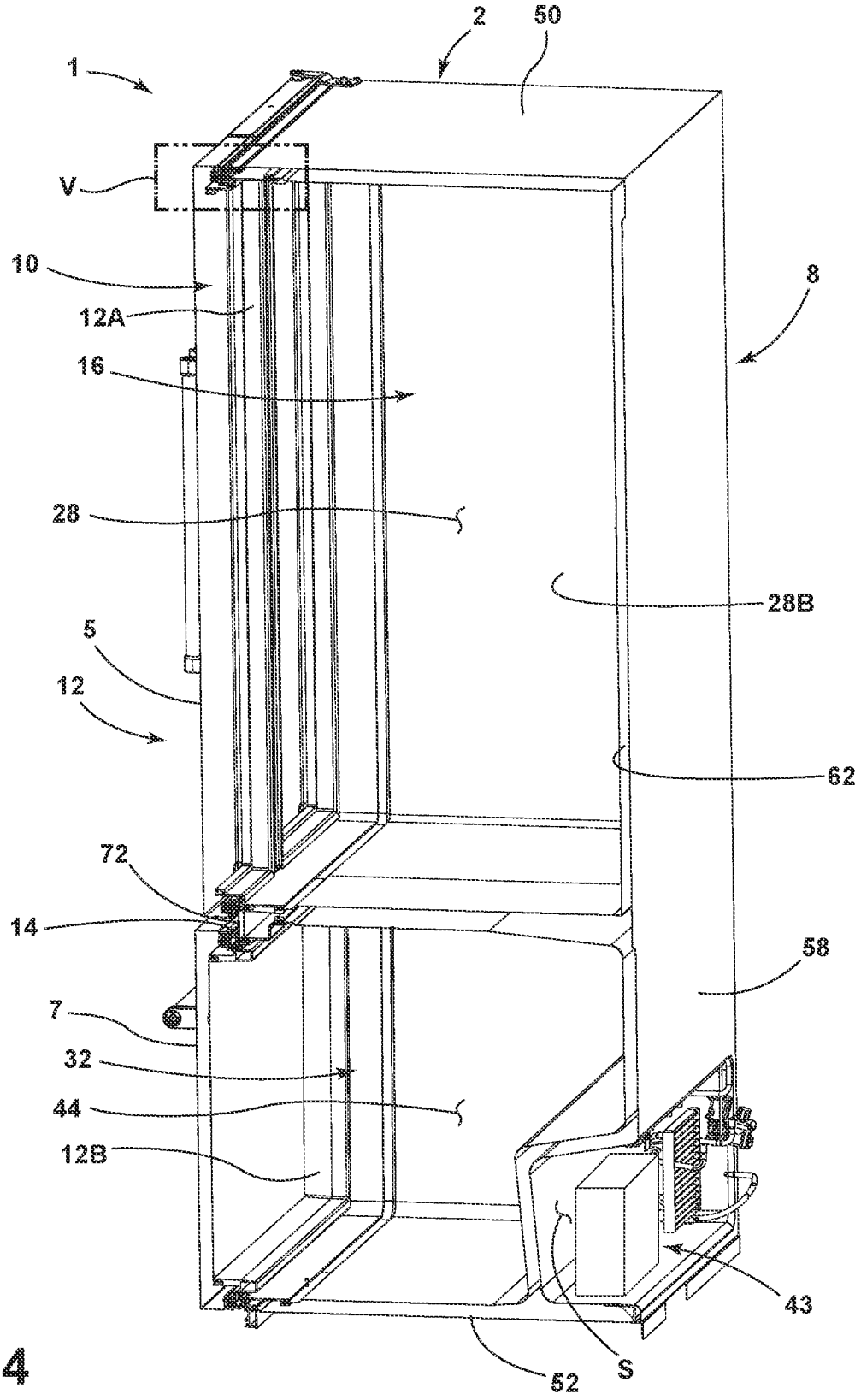
FIG. 4 is a cross-sectional view of the refrigerator of FIG. 1 taken at line IV.

Referring now to FIG. 4, the refrigerator 1 is shown in a cross-sectional view having the refrigerator liner 16 and the freezer liner 32 coupled to the trim breaker 10 at upper and lower openings 12A, 12B, respectively. Further, the exterior wrapper 8 is also coupled to the trim breaker 10, such that the trim breaker 10 interconnects the exterior wrapper 8 with the refrigerator liner 16 and freezer liner 32. Specifically, the trim breaker 10 of the present concept is coupled to the liners 16, 32 and exterior wrapper 8 to hermetically seal the components together as a unitary whole as shown in FIG. 3.

Figure 5:
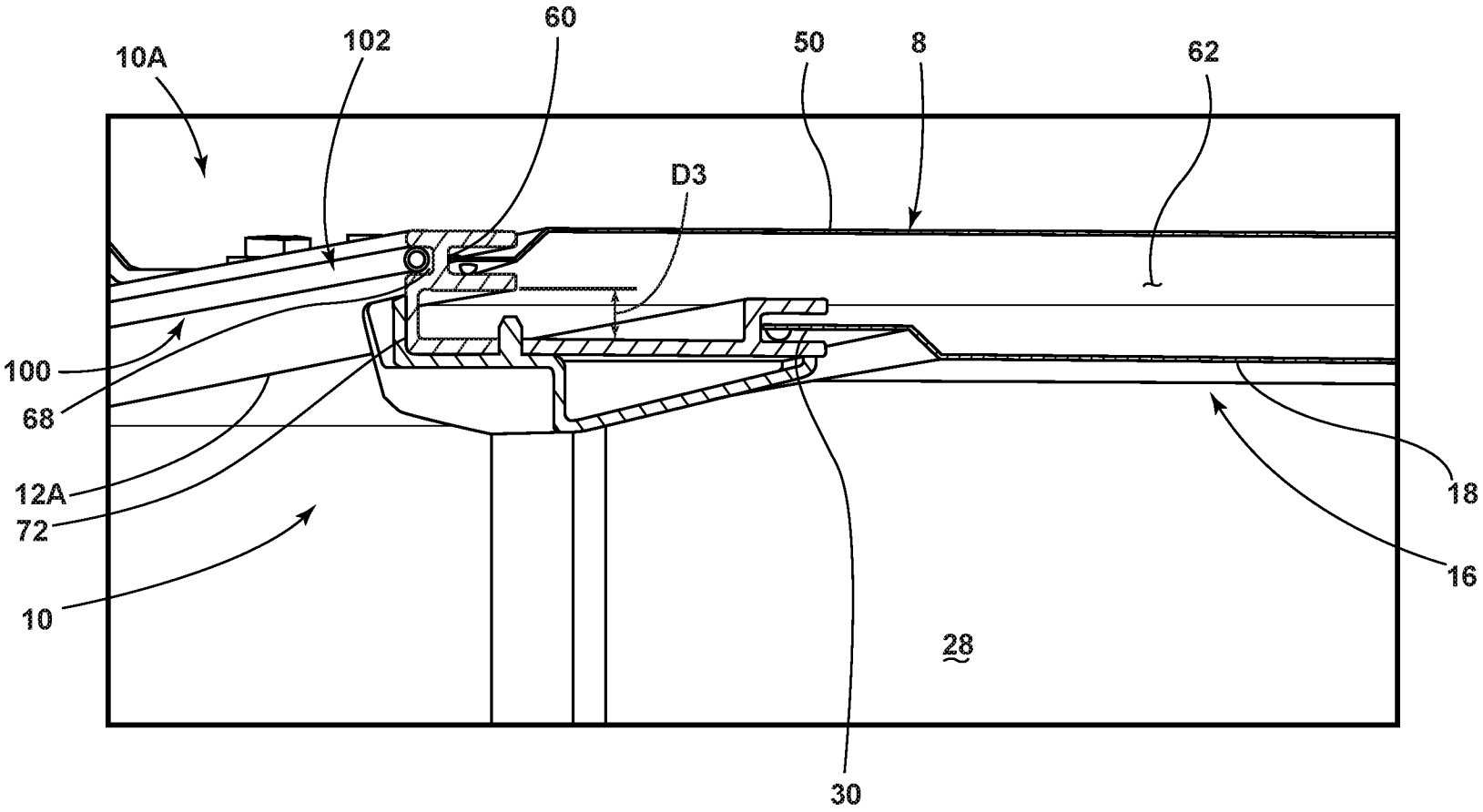
FIG. 5 is a fragmentary cross-sectional view of the thermal bridge taken from location V of FIG. 4.
Figure 6:
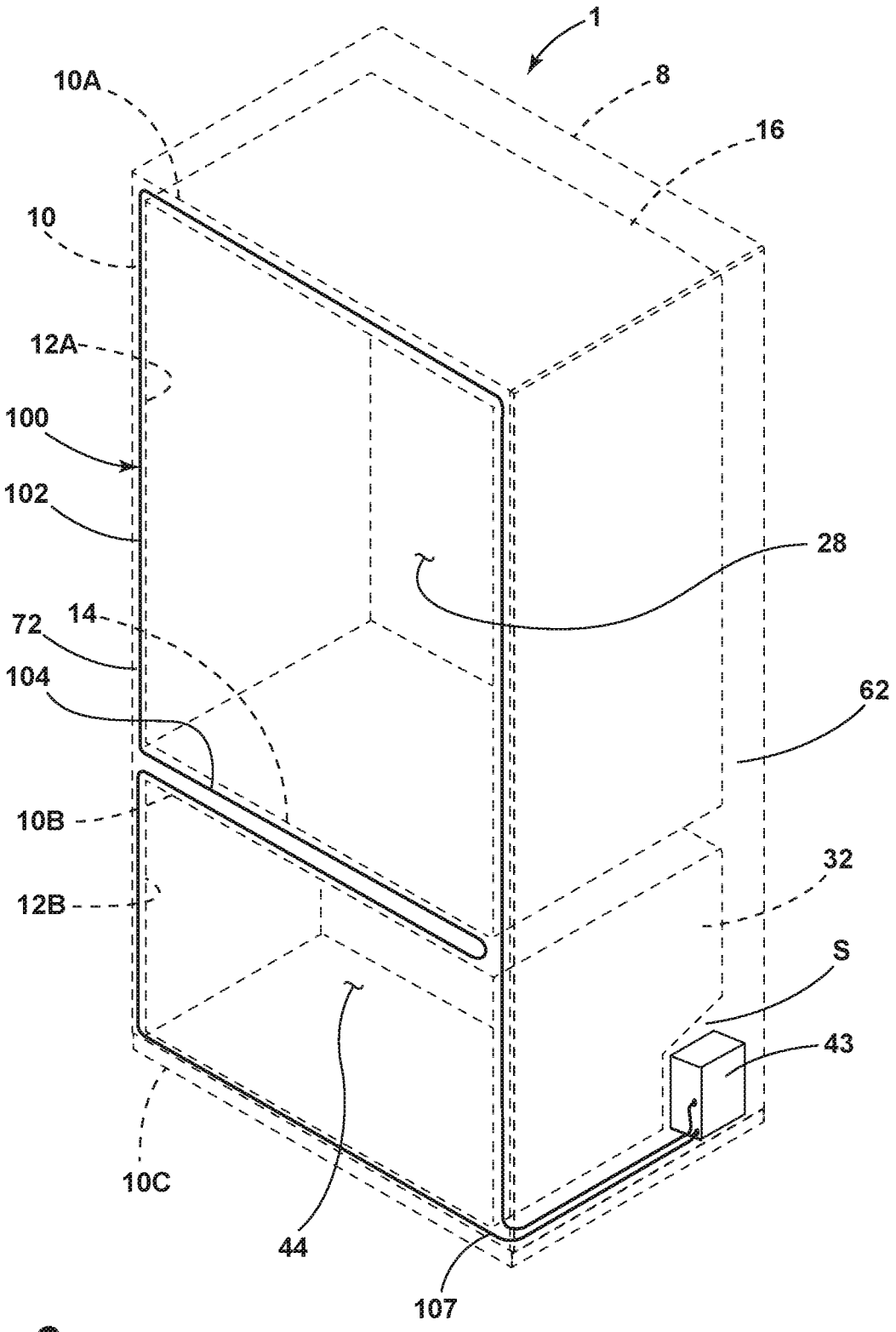
FIG. 6 is a front top perspective view of the cabinet structure of FIG. 3 with portions thereof shown in phantom to reveal a heat loop.

Referring now to FIG. 5, the trim breaker 10 is shown along the upper portion 10A thereof. The trim breaker 10 includes a door-to-cabinet interface 72 that defines a sealing surface for the refrigerator 1 between the trim breaker 10 and the doors 5, 6 and drawer 7 (FIG. 1) thereof. An outwardly opening channel 68 is disposed along the door-to-cabinet interface 72 of the trim breaker 10, and a heat loop 100 is shown positioned therein. The heat loop 100 comprises a continuous conduit of tubing 102 that is routed through the refrigerator 1 (FIG. 1), and is substantially disposed along the door-to-cabinet interface 72, as best shown in FIG. 6. As positioned along a front side of the trim breaker 10, the heat loop 100 is configured to circulate heated refrigerant adjacent to an exterior surface of a cabinet structure 2 during a duty cycle of a compressor. The heat loop 100 may be referred to herein as a conduit, a Yoder loop or a condenser loop, but is not meant to be limited to any one shape or configuration by the term "loop." The heat loop 100 circulates, or otherwise transports, a heated medium, such as heated refrigerant that is generated by the mechanical equipment 43 (FIGS. 4 and 6) when the mechanical equipment 43 is cooling the compartments 28 and 44. The heated refrigerant contained and transported through the tubing 102 of the heat loop 100 provides for an anti-condensation feature to help prevent condensation that can develop when the cold surfaces of the compartments 28 and 44 are exposed to ambient air in which the refrigerator 1 is disposed. This warm and humid air can cause condensation to develop along the door-to-cabinet interface 72 of the trim breaker 10. The circulating warmed refrigerant of the heat loop 100 provides a mitigating factor for combatting condensation buildup, particularly at the door-to-cabinet interface 72 where condensation is likely to occur.

Referring now to FIG. 6, the heat loop 100 positioned in the outwardly opening channel 68 (see FIG. 5) of the trim breaker 10 is substantially disposed around the door-to-cabinet interface 72. As used herein, the term "substantially disposed" indicates that the majority of the conduit defining the heat loop 100 is disposed along the door-to-cabinet interface 72 of the refrigerator 1, where the refrigerator 1 is most susceptible to condensation accumulation. An intermediate portion 104 of the tubing 102 of the heat loop 100 is shown covering the mullion portion 14 of the trim breaker 10. Thus, the heat loop 100 fully surrounds the openings 12A and 12B of the trim breaker 10 along the door-to-cabinet interface 72. Further, a return portion 107 is illustrated as running the heat loop 100 back to the spacing S of the refrigerator 1 where the mechanical equipment 43 is housed that generates the heated refrigerant for circulation within the heat loop 100.

Figure 7:
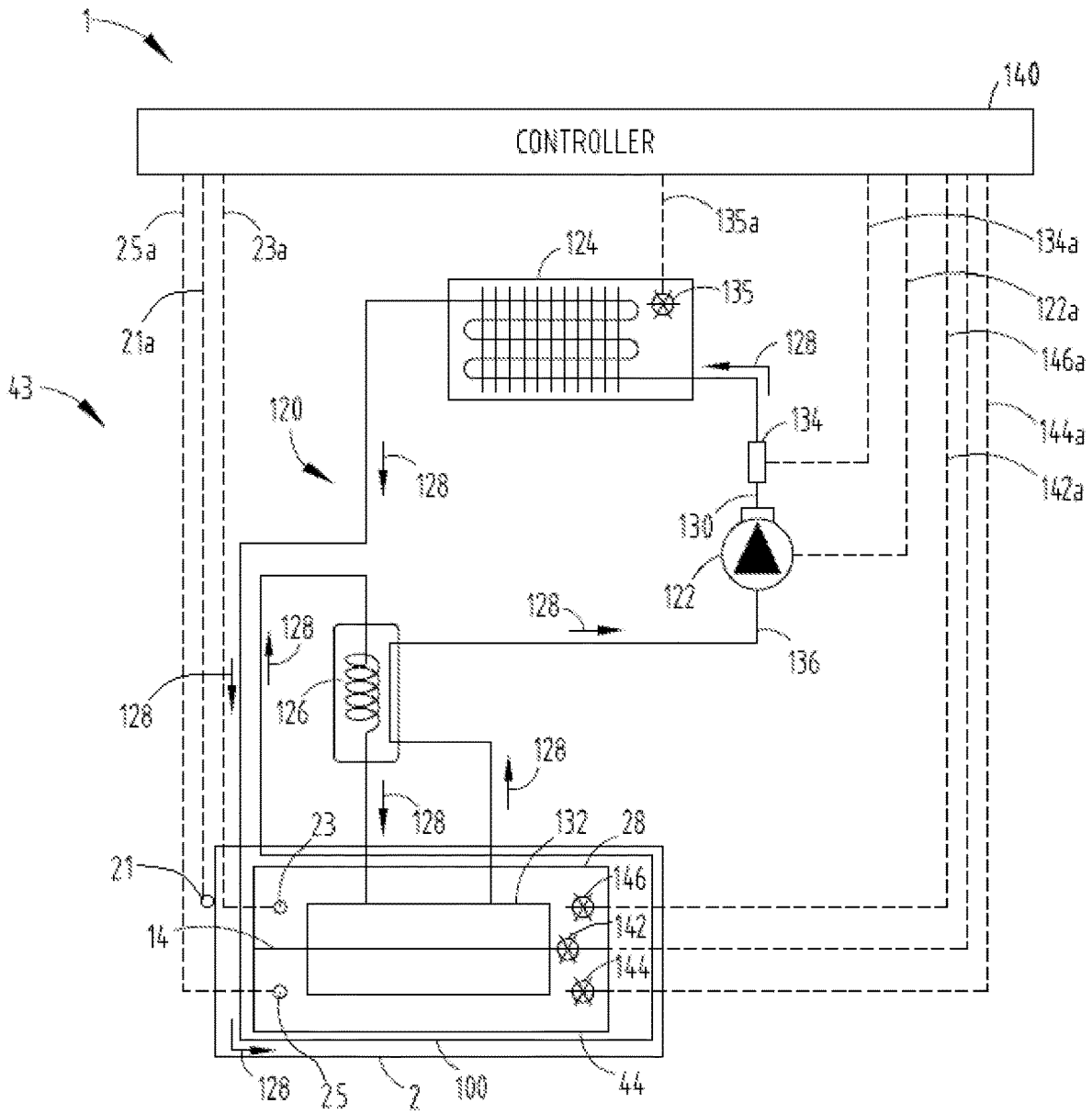
FIG. 7 is a schematic diagram of a refrigerant circuit.

Referring now to FIG. 7, a schematic illustration of refrigerator 1 and its component parts is provided. In FIG. 7, the refrigerator 1 is shown with a refrigerant circuit 120 and various control components. More particularly, the refrigerant circuit 120 includes conduits (not labeled) allowing for a flow of refrigerant 128 through a compressor 122, to a condenser 124, to the heat loop 100, to a pressure reduction device 126, to an evaporator 132 and then back to the compressor 122. In particular, the compressor 122 supplies refrigerant 128 through a compressor outlet line 130 to the condenser 124. A check valve 134 may be placed in the compressor outlet line 130 to prevent reverse migration of refrigerant back into the compressor 122 during compressor OFF cycles. The condenser 124 is optionally paired with a variable-speed condenser fan 135. The condenser fan 135 can operate to improve an efficiency of the condenser 124 by imparting a flow of ambient air over the condenser 124. This additional air flow over the condenser 124 facilitates additional heat transfer (i.e., heat removal) during the phase change of refrigerant 128 from a gas to a liquid within condenser 124. As such, the refrigerant 128 is heated within the condenser 124 and directed to the heat loop 100. As noted above, the heat loop 100 is contemplated to be positioned at the door-to-cabinet interface 72 along the refrigerator 1, as best shown in FIG. 6. In FIG. 7, the refrigerant 128 then flows out of the heat loop 100 and is presented to the pressure reduction device 126, which is located upstream from the evaporator 132. Accordingly, the refrigerant 128 flows through the pressure reduction device 126 and into the evaporator 132. The refrigerant 128 then exits the evaporator 132 and flows through a compressor inlet line 136 back into the compressor 122, thus completing refrigerant circuit 120.

In the schematic illustration of FIG. 7, the compressor 122 may be a single-speed or single-capacity compressor that is appropriately sized based on the particular system parameters of the refrigerator 1. In addition, the compressor 122 may also be a multi-capacity compressor capable of operation at any one of a finite group of capacities or speeds. Still further, the compressor 122 may also be a variable capacity or variable speed compressor (e.g., a variable speed, reciprocating compressor operating from 1600 to 4500 rpm or 3:1 capacity range) or a linear compressor, capable of operating within a large, continuous range of compressor speeds and capacities. However, if the compressor 122 is configured as a single-speed or single-capacity compressor, the refrigerator 1 will likely include variable-speed compartment fans and/or evaporator fans, such as fans 144, 146, 142 shown in FIG. 7.

As further shown in FIG. 7, a controller 140 is provided. The controller 140 is contemplated to control the general operations of the refrigerator 1. In general, the controller 140 operates the compressor 122, for example, to maintain the refrigerator compartment 28 and the freezer compartment 44 at various temperatures desired by the user. The controller 140 may operate the condenser fan 135 (if present) to further effect control of the temperature in the refrigerator compartment 28 and the freezer compartment 44. In addition, the controller 140 may operate an evaporator fan 142, a freezer compartment fan 144, a refrigerator compartment fan 146 and/or the check valve 134 to maintain desired temperatures in the refrigerator compartment 28 and the freezer compartment 44. Furthermore, the controller 140 may be configured to control and optimize the thermodynamic efficiency of the refrigerator 1 by controlling or adjusting speeds of the compressor 122, the condenser fan 135, the evaporator fan 142, the freezer compartment fan 144 and/or the refrigerator compartment fan 146.

The controller 140 is configured to receive and generate control signals via interconnecting wires provided in the form of leads arranged between and coupled to the compressor 122, the condenser fan 135, the evaporator fan 142, the freezer compartment fan 144, and the refrigerator compartment fan 146. In particular, a lead 122*a* is arranged to couple the controller 140 with the compressor 122. Lead 134*a* is arranged to couple the controller 140 with the check valve 134. Lead 135*a* is arranged to couple the controller 140 with the condenser fan 135. Further, leads 142*a*, 144*a*, and 146*a* are arranged to couple the controller 140 with the evaporator fan 142, the freezer compartment fan 144, and the refrigerator compartment fan 146, respectively.

In the embodiment illustrated in FIG. 7, the controller 140 also relies on compartment temperature sensors to perform its intended function within the refrigerator 1. In particular, controller 140 is operably coupled to sensors 23 and 25 via leads 23*a* and 25*a*, respectively. As shown in FIG. 7, the sensors 23 and 25 are arranged in the refrigerator compartment 28 and the freezer compartment 44, respectively. The sensors 23 and 25 are configured to generate signals indicative of temperature levels in their respective compartments 28 and 44, and send this data to the controller 140. Thermistors, thermocouples, and other types of temperature sensors known in the art are suitable for use as the sensors 23 and 25. Further, a sensor 21 is shown in FIG. 7 and is contemplated to be provided on an exterior surface of the refrigerator 1 to in turn generate signals indicative of ambient air temperature levels from the environment in which the refrigerator 1 is disposed. The sensor 21 is also configured to provide temperature information for a particular surface of the refrigerator 1 in which the sensor 21 is disposed. Information provided from the sensor 21 is delivered to the controller 140 via lead 21*a*. It is further contemplated that the sensors 21, 23 and 25 may be wirelessly coupled to the controller 140 for collecting and delivering signal information thereto.

The present concept provides for the controller 140 to adjust cooling component parameters to initiate circulation of heated refrigerant 128 through the heat loop 100 as an anti-condensation measure of the refrigerator 1.

As shown in FIG. 7, the sensor 21 is contemplated to be an exterior sensor positioned on an exterior surface of the refrigerator 1. An exterior surface of the refrigerator 1 is used herein to denote a portion of the exterior wrapper 8 or the trim breaker 10, or a cover covering the trim breaker 10 that is exposed to the outside environment or ambient air in which the refrigerator 1 is disposed. The sensor 21 may include multiple sensors that can provide the different values necessary for running a runtime algorithm for the refrigerant circuit 120. The controller 140 is configured to receive data from the sensor 21 via lead 21*a* which operably couples the sensor 21 to the controller 140. The data received from sensor 21 is used in controlling the refrigerant circuit 120, such as runtime, duration, modulated power level, and other like parameters of the mechanical equipment 43 used to cool the compartments 28, 44 of the refrigerator 1.

Using information collected from the sensors 21, 23 and 25, the controller 140 of the present concept is configured to provide a more effective anti-condensation feature for the refrigerator 1. As noted above, the controller 140 may be hardwired to the sensors 21, 23 and 25, or may be electronically coupled with the sensors 21, 23 and 25 using a wireless connection. As used herein, the sensors 21, 23 and 25 may be described as monitoring, sensing, detecting and providing data regarding the refrigerator compartments 28, 44, the ambient air around the refrigerator 1, the relative humidity, or the exterior surfaces of the refrigerator 1. All such terms, and other like terms, are contemplated to indicate that the sensors 21, 23 and 25 are configured to gather data and send the same to the controller 140 for processing.

The sensors 21, 23 and 25 may, either alone or in combination, include temperature sensors configured to provide temperature values for the ambient air temperature from the environment in which the refrigerator 1 is located, the refrigerator compartment temperature, and the freezer compartment temperature, respectively. Such temperature sensing units may include thermistors or other like sensors. Such relative humidity sensing units may also include optical sensors configured to detect the presence of condensation. Still further, the sensors 21, 23 and 25 may, either alone or in combination, include dew point sensing units configured to provide dew point temperature values for the environment in which the refrigerator 1 is disposed. Such dew point sensing units may be configured to send dew point calculations to the controller 140 for further processing and for controlling the refrigerant circuit 120 (and associated heat loop 100).

As used in conjunction with the sensors 21, 23 and 25, the mechanical equipment 43 of the refrigerator 1 can be adjusted to effectively combat the development of dew/condensation on surfaces of the refrigerator in a more energy efficient manner, and in real time.

As calculated, the dew point temperature (Td) will be compared with a temperature value of the exterior surface of the refrigerator 1 itself (Txr). Specifically, the temperature value (Txr) of the refrigerator 1 may be a temperature of a particular surface of the refrigerator 1 taken by sensor 21 in an area where condensation is likely to form, such as the door-to-cabinet interface 72 of the refrigerator 1.

When the exterior surface of the refrigerator 1 has a temperature value that is equal to or lower than the dew point temperature of the ambient air, condensation is likely to form on that exterior surface. Depending on how close the temperature (Txr) of the exterior surface of the refrigerator 1 is to the dew point temperature (Td), and also depending on the trend of the Txr (whether increasing or decreasing), the refrigerant circuit 120 can be adjusted by the controller 140. When the temperature value of an exterior surface of the cabinet structure 2 reaches a threshold temperature relative to the dew point temperature value, a refrigerant circulation sequence can be initiated.

Generally, the controller 140 will initiate a refrigerant circulation sequence as the temperature (Txr) of the exterior surface of the refrigerator 1 approaches the dew point temperature (Td) to keep moisture from developing on exterior surface of the refrigerator 1. As such, a threshold temperature may be considered the dew point temperature (Td) minus 0.8° C. ((Td)−0.8° C.)=threshold temperature). In this way, a refrigerant circulation sequence can be triggered as the temperature (Txr) of the exterior surface of the refrigerator 1 approaches a temperature level that is less than 1° C. away from the dew point temperature (Td). The present concept provides for another way in which a refrigerant circulation sequence can be initiated to circulate heated refrigerant 128 through the heat loop 100. If the refrigerator 1 is provided with a vacuum insulated cabinet structure 2 and vacuum insulated doors 5, 6, the thermal conductivity can lessen over time, such that insulating performance may need to be evaluated. For example, the refrigerator 1 may be designed to allow a pressure level increase from 1 to 10 mbar over the life of the product. The door-cabinet interface 72 is often the first place where condensation will be observed if the insulation performance begins to lessen.

One way to help prevent external condensation from forming on an external surface of the refrigerator 1 is detailed below. In a first step, the dew point is calculated by the controller 140 using the sensor 21. This requires the sensor 21 to be capable of measuring the ambient air temperature level and the relative humidity level. With the current temperature and humidity conditions, the dew point can be calculated by the controller 140. After the dew point is calculated, potential condensation conditions can be detected in a second step. This can be done by running an insulation performance test to estimate the current insulation performance by observing the rate of temperature rise in either the refrigerator compartment 28 or the freezer compartment 44 during an off-cycle of the compressor 122 and, as a corollary, the refrigerant circuit 120. When the compressor 122 is running, the refrigerant 128 in the heat loop 100 warms the cabinet structure 2 along the areas where the heat loop 100 is routed, such as the door-to-cabinet interface 72. When the compressor 122 is off, no refrigerant 128 is pumped through the heat loop 100 and these areas will then cool. Thus, the rate of temperature rise in either the refrigerator compartment 28 or the freezer compartment 44 during an off-cycle of the refrigerant circuit 120 can be combined with the ambient air temperature level taken from the first step to estimate how effective the insulation is and if the performance of the insulation has degraded over time.

Off-cycle readings can be affected by many outside factures, such as a user opening the refrigerator doors 5, 6, or if a user puts something warm inside the refrigerator compartment 28 or the freezer compartment 44 to be cooled. Such occurrences will cause for the off-cycle time to be shorter than normal. To compensate for these variations, the controller 140 can be programmed to evaluate off-cycles in which no door opening event occurred. Said differently, the doors (5, 6) of the refrigerator 1 are continuously closed and retained in the closed position during the off-duty cycle in which the first temperature level and the second temperature level are sensed by the sensors (23 or 25). Several measurements could be taken during such an off-cycle to thereby provide a series of temperature levels sensed, from which an average can be calculated. The calculated average rate of temperature rise can be evaluated by the controller 140 in order to reduce variation due to other factors and provide a consistent number for the average rate of temperature rise. If the average rate of temperature rise evaluated meets a predetermined threshold, the controller 140 can initiate a duty cycle of the compressor 122. Condensation will form on surfaces that have a surface temperature below the dew point of the ambient air. Thus, if insulation performance is less than optimal, increased rates of temperature rise will be detected in the refrigerator compartment 28 or the freezer compartment 44. This will lead to cooler temperatures for the exterior surfaces of the refrigerator 1, and therefore, these exterior surface temperatures may fall below the dew point of the ambient air in which the refrigerator 1 is located.

Determining the rate of temperature rise can be done using sensor 23 or sensor 25, or both. In this way, either the refrigerator compartment temperature level or the freezer compartment temperature level can be evaluated for a rising temperature rate over time. This method generally includes sensing a first temperature level using the one or more sensors (23 or 25) within the storage compartment (28 or 44) at a first time interval during an off-duty cycle of the compressor 122; sensing a second temperature level using the one or more sensors (23 or 25) within the storage compartment (28 or 44) at a second time interval during the off-duty cycle of the compressor 122; calculating a rate of temperature rise within the storage compartment (28 or 44) using the controller 140; initiating the duty cycle of the compressor 122 when the rate of temperature rise reaches a predetermined threshold rate; and changing an operating parameter of the refrigerator 1 to increase the duty cycle of the compressor 122. A threshold rate of temperature rise may include a fixed value that is programmed to initiate the circulation of refrigerant by initiating the duty cycle of the compressor 122 in order to avoid condensation. The threshold rate of temperature rise and the threshold temperature noted above can be stored values retained by and preprogrammed into the controller 140. Further, the threshold rate of temperature rise and the threshold temperature noted above are exemplary values only, and are not mean to limit the scope of the present concept.

If external condensation is predicted by either the first step or the second step, then a control algorithm of the controller 140 can be adjusted by changing an operating parameter of the refrigerator 1 to increase the duty cycle (runtime) of the compressor 122 in order to circulate warm refrigerant 128 through the heat loop 100 for longer time intervals. An increased time interval for the circulation of warm refrigerant 128 helps to reduce or eliminate external condensation at the door-to-cabinet interface 72 by warming the exterior surfaces of the refrigerator 1.

There are several methods to change an operating parameter of the refrigerator 1 to thereby adjust the control algorithm of the controller 140 to increase the duty cycle of the compressor 122. The adjustments noted below are provided as operating parameters of the refrigerator 1 for reducing the efficiency of the refrigeration system, such that the compressor 122 will run for a longer duty cycle in order to compensate for the inefficiency. With the duty cycle of the compressor 122 provided for an increased time interval, the circulation of refrigerant 128 in the heat loop 100 of the refrigerant circuit 120 will also increase for the same increased time interval.

A first operating parameter adjustment involves an adjustment of a speed of the compressor 122 as run during a duty cycle. For example, if the compressor 122 is a variable speed compressor, or a linear compressor which can be run at variable speeds, the speed at which the compressor 122 is run can be reduced to a lower or lowest speed setting during a duty cycle of the compressor 122 in order to increase the overall run time of the compressor 122 during a duty cycle. If the evaporator fan 142 is variable speed fan or a pulse width modulation (PWM) controlled device, the speed of the evaporator fan 142 can be reduced to increase the run time of the compressor 122 as another operating parameter adjustment. If the evaporator fan 142 is not a variable speed fan, then the evaporator fan 142 could be turned off or deactivated during the cooling cycle to get a similar effect. With the evaporator fan 142 reduced in speed or turned off, the duty cycle of the compressor 122 will increase from a standard duty cycle, as the storage compartment (28 or 44) will take longer to cool. Similarly, if the condenser fan 135 is variable speed or PWM controlled device, the speed of the condenser fan 135 could be reduced as another operating parameter adjustment. If the condenser fan 135 is not a variable speed or PWM controlled device, then the condenser fan 135 could be turned off or deactivated during the cooling cycle to get a similar effect. With the condenser fan 135 reduced in speed or turned off, the duty cycle of the compressor 122 will increase as compared to a standard duty cycle, as the condenser 124 will take longer to condense the refrigerant 128 into a liquid medium. Reducing air flow over the condenser 124 by manipulating the behavior of the condenser fan 135 has the additional benefit of raising the condensing temperature. As the condensing temperature increases, so does the temperature of the refrigerant 128 cycled through the heat loop 100 which has the additional benefit of warming the door-to-cabinet interface 72 in an effort to combat or avoid external condensation.

According to one aspect of the present disclosure, a method of controlling condensation on an appliance includes the steps of (1) providing a refrigerator with a cabinet structure, a door operably coupled to the cabinet structure for selectively providing access to a storage compartment, a compressor, one or more sensors, a controller operably coupled to the compressor and the one or more sensors, a heat loop operably coupled to the compressor, wherein the heat loop circulates a heated medium during a duty cycle of the compressor; (2) sensing a first temperature level using the one or more sensors within the storage compartment at a first time interval during an off-duty cycle of the compressor; (3) sensing a second temperature level using the one or more sensors within the storage compartment at a second time interval during the off-duty cycle of the compressor; (4) calculating a rate of temperature rise within the storage compartment using the controller; (5) initiating the duty cycle of the compressor when the rate of temperature rise reaches a predetermined threshold rate; and (6) changing an operating parameter of the refrigerator to increase the duty cycle of the compressor.

According to another aspect of the disclosure, the heat loop is substantially disposed along a door-to-cabinet interface of the cabinet structure.

According to another aspect of the disclosure, the heated medium is a refrigerant.

According to another aspect of the disclosure, the door of the refrigerator is continuously closed during the off-duty cycle in which the first temperature level and the second temperature level are sensed.

According to another aspect of the disclosure, the first and second temperature levels are first and second temperature levels of a series of temperature levels sensed during the off-duty cycle of the compressor.

According to another aspect of the disclosure, an average rate of temperature rise within the storage compartment is calculated using data from the series of temperature levels sensed during the off-duty cycle of the compressor, and the duty cycle of the compressor is initiated when the average rate of temperature rise within the storage compartment reaches the predetermined threshold rate.

According to another aspect of the disclosure, the step of changing an operating parameter of the refrigerator to increase the duty cycle of the compressor includes reducing a speed of the compressor.

According to another aspect of the disclosure, the refrigerator includes an evaporator fan, and the step of changing an operating parameter of the refrigerator to increase the duty cycle of the compressor includes reducing a speed of the evaporator fan.

According to another aspect of the disclosure, the step of reducing a speed of the evaporator fan further includes deactivating the evaporator fan.

According to another aspect of the disclosure, the refrigerator includes a condenser fan, and the step of changing an operating parameter of the refrigerator to increase the duty cycle of the compressor includes reducing a speed of the condenser fan.

According to another aspect of the disclosure, the step of reducing a speed of the condenser fan further includes deactivating the condenser fan.

According to another aspect of the present disclosure, a method of controlling condensation on an appliance includes the steps of (1) providing a refrigerator having a refrigerant circuit with a heat loop, wherein the heat loop is configured to circulate heated refrigerant adjacent to an exterior surface of a cabinet structure during a duty cycle of a compressor; (2) using one or more sensors to collect data, wherein the data includes a temperature value of the exterior surface of the cabinet structure, an ambient air temperature value associated with the exterior surface of the cabinet structure, and a relative humidity value associated with the exterior surface of the cabinet structure; (3) sending the data to a controller for processing; (4) calculating a dew point temperature value from the data using the controller; (5) comparing the dew point temperature value with the temperature value of the exterior surface of the cabinet structure using the controller; (6) initiating the duty cycle of the compressor when the temperature value of the exterior surface of the cabinet structure reaches a threshold temperature relative to the dew point temperature value; and (7) changing an operating parameter of the refrigerator to increase a time interval for which the duty cycle of the compressor is run.

According to another aspect of the disclosure, the step of changing an operating parameter of the refrigerator to increase a time interval for which the duty cycle of the compressor is run includes reducing a speed of the compressor.

According to another aspect of the disclosure, the refrigerator includes an evaporator fan, and the step of changing an operating parameter of the refrigerator to increase a time interval for which the duty cycle of the compressor is run includes reducing a speed of the evaporator fan.

According to another aspect of the disclosure, the step of reducing a speed of the evaporator fan further includes deactivating the evaporator fan.

According to another aspect of the disclosure, the refrigerator includes a condenser fan, and the step of changing an operating parameter of the refrigerator to increase a time interval for which the duty cycle of the compressor is run includes reducing a speed of the condenser fan.

According to another aspect of the disclosure, the step of reducing a speed of the condenser fan further includes deactivating the condenser fan.

According to another aspect of the present disclosure, a method of controlling condensation on an appliance includes the steps of (1) providing a refrigerator having a refrigerant circuit with a heat loop, wherein the heat loop is configured to circulate heated refrigerant within a cabinet structure during a duty cycle of a compressor, and further wherein the refrigerator includes a storage compartment and an insulation space substantially surrounding the same; (2) running an insulation performance test, wherein a rate of temperature rise within the storage compartment is calculated during an off-duty cycle of the compressor; (3) sending the data to a controller for processing; (4) initiating the duty cycle of the compressor when the rate of temperature rise reaches a predetermined threshold rate; and (5) changing an operating parameter of the refrigerator to increase a time interval for which the duty cycle of the compressor is run.

According to another aspect of the disclosure, a series of temperature levels are sensed within the storage compartment during the off-duty cycle of the compressor, and the refrigerator includes a door to the storage compartment that remains closed during the off-duty cycle of the compressor in which the series of temperature levels are sensed, and an average rate of temperature rise within the storage compartment is calculated using data from the series of temperature levels sensed during the off-duty cycle of the compressor, and the duty cycle of the compressor is initiated when the average rate of temperature rise within the storage compartment reaches the predetermined threshold rate.

According to another aspect of the disclosure, the step of changing an operating parameter of the refrigerator to increase a time interval for which the duty cycle of the compressor is run includes at least one of the following operating parameters: reducing a speed of the compressor; reducing a speed of an evaporator fan; and reducing a speed of a condenser fan.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A method of controlling condensation on an appliance, the method comprising the steps of:

providing a refrigerator with a cabinet structure, a door operably coupled to the cabinet structure for selectively providing access to a storage compartment, a compressor, one or more sensors, a controller operably coupled to the compressor and the one or more sensors, a heat loop operably coupled to the compressor, wherein the heat loop circulates a heated medium during a duty cycle of the compressor;

sensing a first temperature level using the one or more sensors within the storage compartment at a first time interval during an off-duty cycle of the compressor;

sensing a second temperature level using the one or more sensors within the storage compartment at a second time interval during the off-duty cycle of the compressor;

calculating a rate of temperature rise within the storage compartment using the controller, wherein the rate of temperature rise is defined as a rise in temperature from the first temperature level to the second temperature level over time as measured from the first time interval to the second time interval;

initiating the duty cycle of the compressor when the rate of temperature rise reaches a predetermined threshold rate;

circulating the heated medium through the heat loop during the duty cycle of the compressor; and changing an operating parameter of the refrigerator to increase the duty cycle of the compressor.

2. The method of claim 1, wherein the heat loop is disposed along a door-to-cabinet interface of the cabinet structure.

3. The method of claim 1, wherein the heated medium is a refrigerant.

4. The method of claim 1, wherein the door of the refrigerator is continuously closed during the off-duty cycle in which the first temperature level and the second temperature level are sensed.

5. The method of claim 4, wherein the first and second temperature levels are first and second temperature levels of a series of temperature levels sensed during the off-duty cycle of the compressor.

6. The method of claim 5, wherein an average rate of temperature rise within the storage compartment is calculated using data from the series of temperature levels sensed during the off-duty cycle of the compressor, and further wherein the duty cycle of the compressor is initiated when the average rate of temperature rise within the storage compartment reaches the predetermined threshold rate.

7. The method of claim 1, wherein the step of changing an operating parameter of the refrigerator to increase the duty cycle of the compressor includes reducing a speed of the compressor.

8. The method of claim 1, wherein the refrigerator includes an evaporator fan, and further wherein the step of changing an operating parameter of the refrigerator to increase the duty cycle of the compressor includes reducing a speed of the evaporator fan.

9. The method of claim 8, wherein the step of reducing a speed of the evaporator fan further includes deactivating the evaporator fan.

10. The method of claim 1, wherein the refrigerator includes a condenser fan, and further wherein the step of changing an operating parameter of the refrigerator to increase the duty cycle of the compressor includes reducing a speed of the condenser fan.

11. The method of claim 10, wherein the step of reducing a speed of the condenser fan further includes deactivating the condenser fan.

* * * * *